US005666672A

United States Patent [19]

Birsel et al.

[11] Patent Number: 5,666,672

[45] Date of Patent: Sep. 16, 1997

[54] TOILET ATTACHMENT WITH EASILY DETACHABLE SEAT

[75] Inventors: Ayse Birsel; Noriko Hiraga; Junichi Tani; Kenichi Nagato; Koichi Watanabe; Kuniaki Shinohara, all of Kita-Kyushu, Japan

[73] Assignee: Toto Ltd., Fukuoka, Japan

[21] Appl. No.: 530,359

[22] PCT Filed: Feb. 8, 1995

[86] PCT No.: PCT/JP95/00167

§ 371 Date: Feb. 28, 1996

§ 102(e) Date: Feb. 28, 1996

[87] PCT Pub. No.: WO94/21970

PCT Pub. Date: Aug. 17, 1995

[30] Foreign Application Priority Data

Feb. 10, 1994 [JP] Japan ..... 6-036380

[51] Int. Cl.[6] ..... A47K 13/12

[52] U.S. Cl. ..... 4/236; 4/447; 4/420.4; 4/420.2; 4/DIG. 6

[58] Field of Search ..... 4/447, 240, 236, 4/237, DIG. 6, 420.2, 420.4, 486, 469, 473

[56] References Cited

U.S. PATENT DOCUMENTS

| | | | |
|---|---|---|---|
| 3,471,874 | 10/1969 | Dixon . | |
| 4,173,802 | 11/1979 | Wikstrom | 4/236 |
| 4,628,548 | 12/1986 | Kurosawa et al. . | |
| 5,010,601 | 4/1991 | Kobayashi et al. . | |
| 5,025,511 | 6/1991 | Takeda et al. | 4/447 |
| 5,279,001 | 1/1994 | Vento | 4/447 |
| 5,341,517 | 8/1994 | Bly | 4/240 |
| 5,421,039 | 6/1995 | Hirashiba et al. | 4/420.4 |

FOREIGN PATENT DOCUMENTS

| | | |
|---|---|---|
| 61-49041 | 3/1986 | Japan . |
| 62-141399 | 9/1987 | Japan . |
| 3-17754 | 4/1991 | Japan . |

*Primary Examiner*—David J. Walczak

*Attorney, Agent, or Firm*—Finnegan, Henderson, Farabow, Garrett & Dunner, L.L.P.

[57] ABSTRACT

A toilet accessory (10) having readily detachable toilet seat (14) and toilet lid (16). A hinge shaft (74) is supported by a pair of posts (72) to protrude away from the housing (12). The hinge portions of the toilet seat and the toilet lid are provided with elastic collars (84) of C-shaped cross-section and are snap-fitted on the hinge shaft (74). When the toilet seat and the toilet lid are to be removed for washing or cleaning, they can be readily dismounted only by pulling with hands. To re-install, the hinge portions readily snap-fit on the hinge shaft by bringing the elastic collars (84) in contact with the hinge shaft (74) and by pressing down the hinge portions. Since the hinge shaft (74) and the posts (72) are exposed out of the housing (12), they can be easily accessed for cleaning.

22 Claims, 14 Drawing Sheets

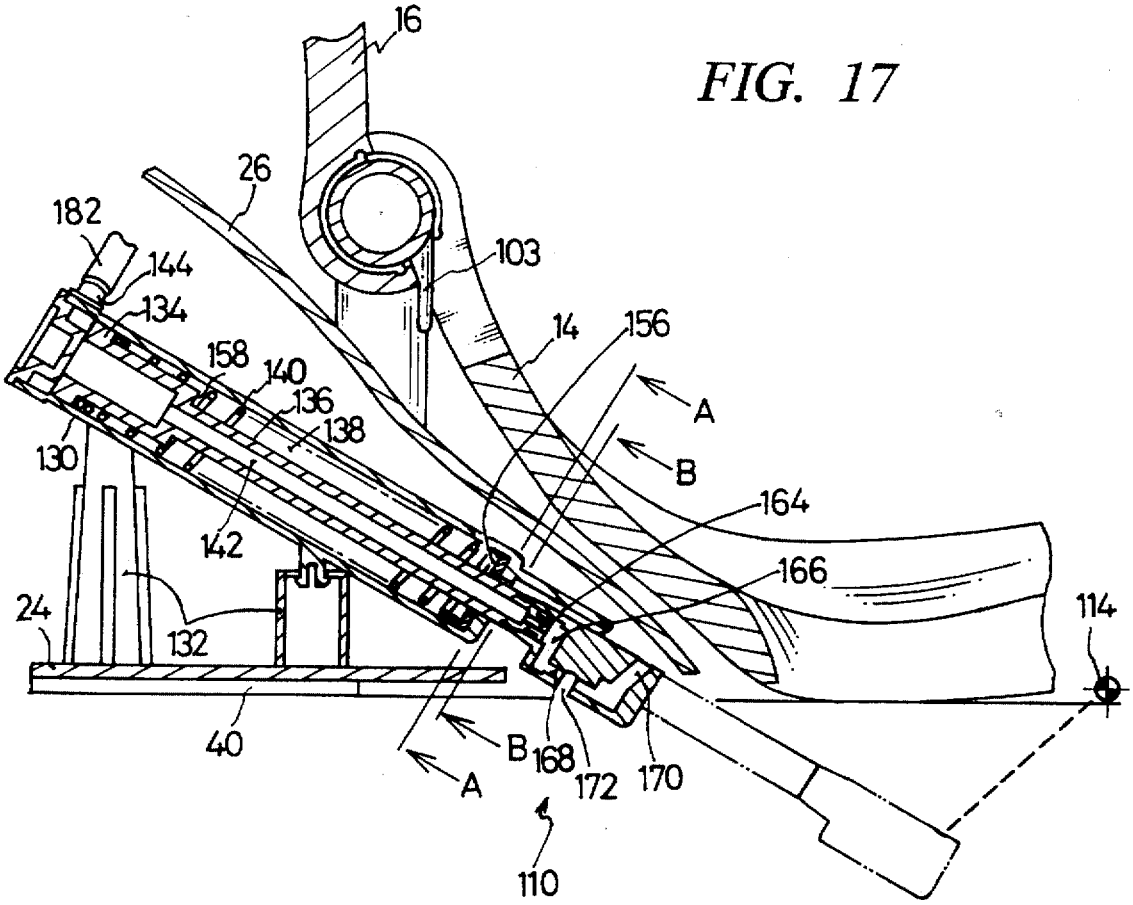
FIG. 17
FIG. 17A
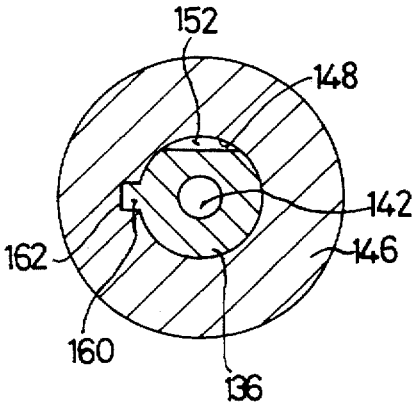
FIG. 17B
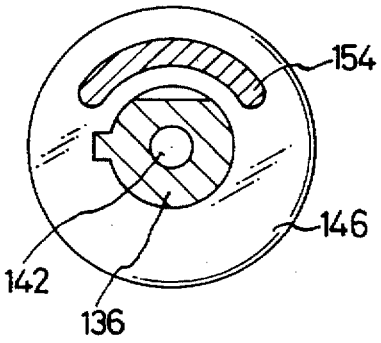

TOILET ATTACHMENT WITH EASILY DETACHABLE SEAT

TECHNICAL FIELD

The present invention relates to a combination of a toilet accessory, such as a bidet system, bowl ventilation equipment and deodorizing device, and a toilet seat and a toilet lid hinged to the housing of the accessory. More specifically, this invention relates to a toilet accessory having a toilet seat and a toilet lid which may be readily detached from the accessory for cleaning and easily re-installed.

BACKGROUND ART

Hitherto, various toilet accessories have widely been used to add sanitary and/or electric functions to the conventional toilets thereby to provide comfortable toilets. Such accessories include bidet systems, warmed water forming devices therefor, hot air blowers, bowl ventilation devices, deodorizers, heated toilet seats, and toilet room heaters.

Typically, a housing for the accessory is mounted on the upper surface of a toilet bowl fixture between a bowl section of the fixture and a flushing water supply section located rearwardly of the bowl and one or more toilet accessories are arranged in the housing. For example, in a toilet described in U.S. Pat. No. 4,628,548 to Kurosawa et al, a bidet system having a movable nozzle is arranged in the housing to eject a spray of water toward the perineal part of the user seated on the toilet seat so as to wash the anus and/or the vagina after defecation or urination. The housing also receives a warmed water reservoir for supplying warmed water to the nozzle, a hot air blower for drying the perineal part after use of the bidet system, a power source for the accessories and an electric control device.

A toilet seat and a toilet lid are pivoted to the accessory housing by associated hinge mechanisms. Generally, a hinge mechanism is designed in such a manner that the toilet seat and the lid may be removed from the housing for the purpose of cleaning. To this end, the hinge pin is removably press-fitted in a bore of the housing. However, removal of the hinge pin in an attempt to detach the toilet seat and lid requires use of a tool such as a screw driver and pliers so that it is difficult, if not possible at all, for an ordinary user, such as a housewife, to remove the hinge pin in the course of routine household affairs. Furthermore, in many instances, the hinge pin is coupled to the housing by means of a pivoting movement control mechanism to prevent an abrupt closure of the toilet seat and lid, as described in U.S. Pat. No. 5,010,601 to Kobayashi et al. In these instances, even a fairly skilled user would be discouraged from attempting to remove the hinge pin. In order to bravely dismount the toilet seat and lid, the hinge pin must be carefully pulled out with reference to a user's manual. If it is not clear how to remove the hinge pin, the toilet seat and lid may be detached only with a potential risk of damaging the component parts.

U.S. Pat. No. 3,471,874 to Dixon discloses a hinge structure designed to enable even a housewife to easily remove the toilet seat and lid. In this structure, a pair of seat posts each having U-shaped jaws are mounted to the bowl fixture. The toilet seat has a pair of hinge pins which has a unique cross section defined by two flat sides and two circular sides to ensure that the hinge pins may be disengaged from the U-shaped jaws of the seat posts and re-engaged when the toilet seat is rotated at a prescribed angle coincident with the apertures of the U-shaped jaws. The brackets of the toilet lid are also provided with the U-shaped jaws which are removably engaged with the hinge pins of the toilet seat.

This hinge structure enjoys the advantage that the toilet seat and the lid may readily be removed whenever desired without using a tool such as a screw driver and a wrench. However, one of the disadvantages is that the inner surface of the U-shaped jaws of the seat posts is not readily accessible from the outside. In the event that the seat posts are fouled by urine splashed too far during urination by a male, it is difficult to wipe and clean the inner surface of the jaws of the seat posts. Another shortcoming is that the toilet seat and the toilet lid cannot be dismounted separately but, instead, the seat and the lid as combined together can be dismounted from the seat posts only jointly, the seat and the lid being then separable from each other. Accordingly, it will be discouraging for a user of weak muscle such as a housewife or a handicapped to dismount the toilet seat and the lid for routine cleaning of the toilet. Furthermore, two steps of operations, i.e., rotation and pull, are required in order to dismount the toilet seat and the lid. If the toilet seat is carelessly rotated when the two flat sides of the hinge pin of the seat are engaged within the slot formed between the jaws of the seat posts or of the toilet lid, there is a risk that the jaws are damaged or broken.

Accordingly, the primary object of the invention is to provide a combined toilet seat and accessory assembly having a hinge mechanism which is simple in structure and which is easy to clean.

Another object of the invention is to provide a hinge structure for the assembly, which permits the toilet seat and the toilet lid to be dismounted from the housing and re-installed thereto separately from each other.

A still another object of the invention is to provide a hinge structure for the assembly, by which the toilet seat and/or the toilet lid may be readily detached from the housing and readily re-installed thereto by a single operation.

A further object of the invention is to provide a hinge structure which enables the toilet seat and/or the toilet lid to be readily removed from and re-installed to the housing regardless of the angular position thereof.

DISCLOSURE OF THE INVENTION

One of the features of the present invention is that a hinge shaft of the hinge mechanism is supported on the housing by a pair of spaced posts so as to be spaced upwardly away from the outer surface of the housing to a level higher than the upper surface of the side portions of the toilet seat, the hinge portions of the toilet seat and the toilet lid being snap-fitted on the hinge shaft.

Since in this way the hinge shaft is exposed upwardly of the housing so that the presence of the hinge shaft is readily perceived by the user, and because the hinge portions of the toilet seat and the toilet lid are snap-fitted on the hinge shaft, the user may readily recognize that the toilet seat and the toilet lid are designed detachable and may visually and easily understand how they can be dismounted. Accordingly, the user is encouraged to remove the toilet seat and the toilet lid for cleaning.

Furthermore, as the hinge portions of the toilet seat and the toilet lid are snap-fitted on the hinge shaft, the toilet seat and the toilet lid may readily be dismounted from the hinge shaft by a single action of application of force regardless of the angular position thereof and may be re-attached to the shaft in an equally simple manner. The toilet seat and the toilet lid may be detached separately where required.

As the hinge shaft and the posts are simple in outer configuration, it is easy to clean the outer surface thereof even though fouled by urine and the like. Since the hinge shaft is exposed upwardly of the housing, it can be readily accessed for cleaning once the toilet seat and the toilet lid have been dismounted. The hinge shaft is less susceptible to fouling by urine because it is located at a high level.

Preferably, the posts supporting the hinge shaft are arranged to extend only outwardly of the housing, without projecting inwardly into the inner space of the housing. With this arrangement, the inner space of the housing may effectively be used to accommodate various toilet accessories so that the housing may be made small and compact yet receiving more items of accessories.

In a preferred embodiment of the invention, the toilet seat is provided with a backrest inclined rearwardly and upwardly to support the pelvis of the user and the side portions of the toilet seat are provided with rearwardly and downwardly inclined support surfaces. With this arrangement, the perineal part of the user as seated on the toilet seat is properly located with respect to a spray nozzle of the bidet system so that the perineal part is effectively washed.

Another feature of the invention is that the toilet seat is ergonomically designed to ensure that the user may sit down with ease. The toilet seat has a generally circular outer periphery and an elongated seat opening, the side portions of the toilet seat having wide support surfaces to better support the thighs of the user. Preferably, the toilet seat is provided with a forwardly and downwardly inclined frontal portion to facilitate the user seated on said seat to open the legs.

In a preferred embodiment, the toilet lid has a concave upper surface to ensure that the user in a bath room may conveniently sit thereon for any purposes. The toilet lid rests upon the toilet seat by way of a surface contact so that a sufficient mechanical strength necessary to support the weight of the user is provided.

In another preferred embodiment, each of the hinge portions of the toilet seat and the toilet lid comprises an elastic member of a C-shaped cross-section. The elastic member has a pair of opposite free ends adapted to resiliently grip the hinge shaft. Preferably, the elastic member is supported by a bearing surface of a semicircular cross-section formed in the hinge portion in such a manner that a spring action is developed by the opposite free ends of the elastic member. The elastic member is preferably provided with a pair of skirts flaring out from the associated opposite free ends to ensure that the elastic member is guided with respect to the hinge shaft when the hinge portion is snap-fitted on the hinge shaft to re-install the toilet seat or the toilet lid.

Preferably, the housing is designed such that it is manually and simply secured to the toilet bowl fixture without using a tool such as a wrench or spanner.

These features and advantages of the invention as well as other features and advantages thereof will become apparent from the following description.

BRIEF DESCRIPTION OF THE DRAWINGS

FIG. 17 is a cross-sectional view of the bidet system shown in FIG. 16, with a plunger being shown as being in its inoperative position;

FIGS. 17A and 17B are cross-sectional views taken along the lines A—A and B—B of FIG. 17, respectively; and, FIG. 18 is a view similar to FIG. 9 but showing the modified forms of the hinge shaft, the posts thereof and the housing.

BEST MODE FOR CARRYING OUT THE INVENTION

Figure 1:
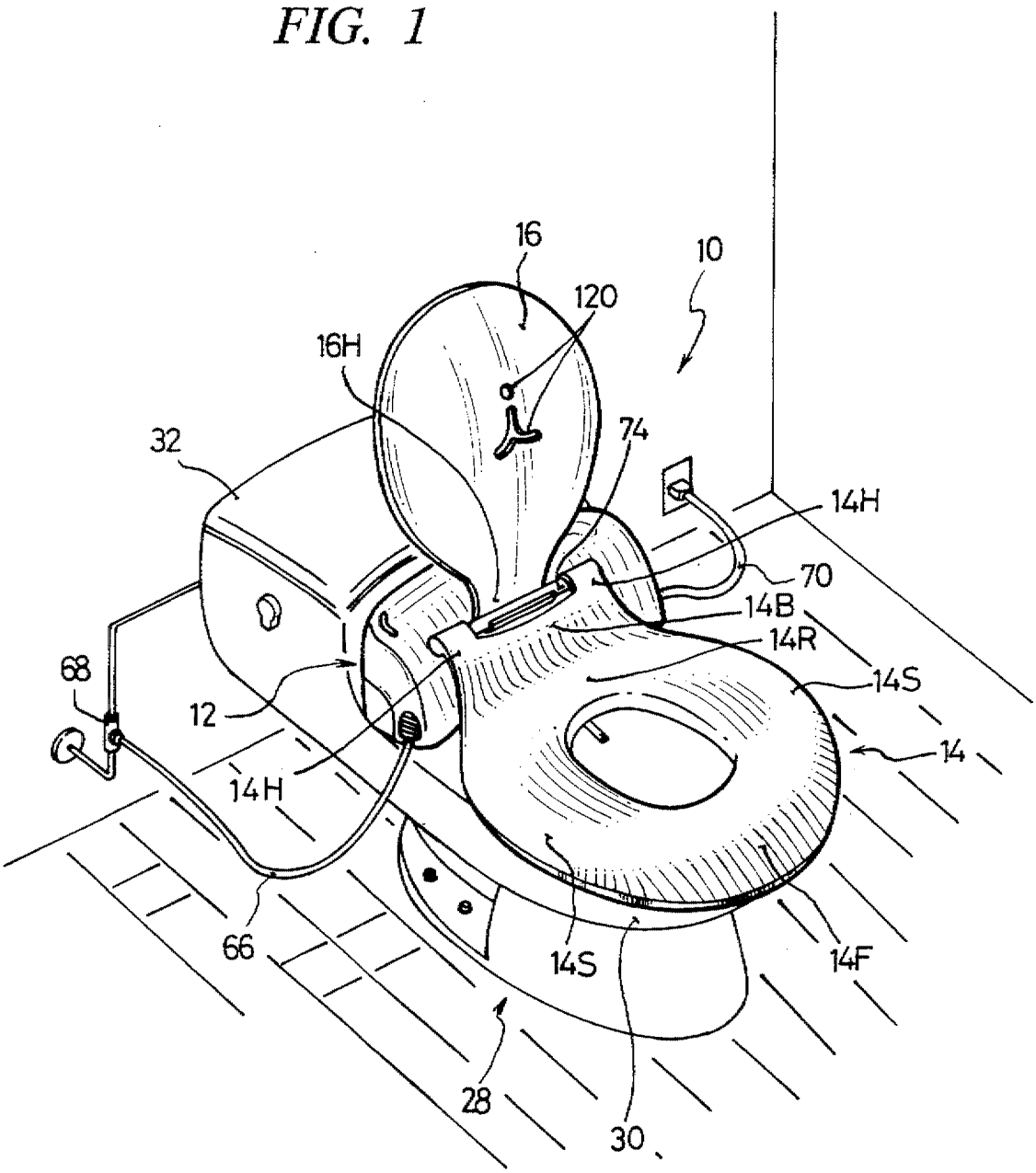
FIG. 1 is a perspective view of the combined toilet seat and accessory assembly according to the invention as mounted to a toilet bowl fixture, with the toilet seat being shown as being in its operative position and the toilet lid in its inoperative position.

Referring to the drawings, the toilet accessory assembly 10 according to the invention includes a housing 12 as well as a toilet seat 14 and a toilet lid 16 hinged to the housing. In the illustrated embodiment, the housing 12 receives a bidet system 18, a warmed water reservoir 20 therefor, and a deodorizer and ventilation fan unit 22, as best shown in FIG. 4.

Figure 4:
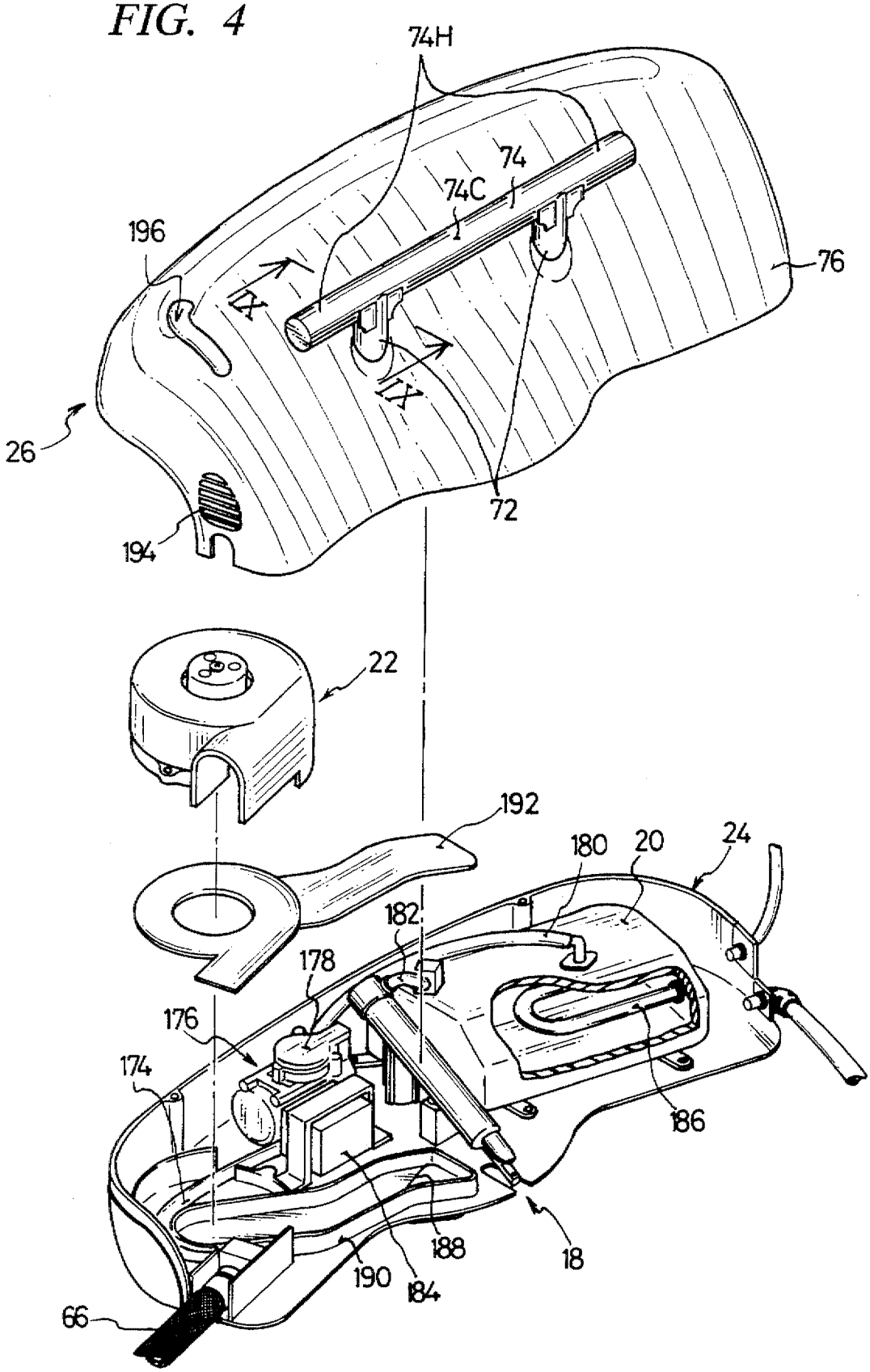
FIG. 4 is an exploded perspective view of the housing of the assembly shown in FIG. 1, with a water reservoir being partly cut away to show an electric heater.

As will be understood from FIG. 4, the housing may conveniently be comprised of a lower housing 24 and an upper housing 26, which are made by molding of an impact resistive plastic such as an acrylonitrile-butadiene-styrene (ABS) resin. The lower housing 24 and the upper housing 26 are joined together by screws and the like, not shown, to form an integral rigid housing 12.

Figure 7:
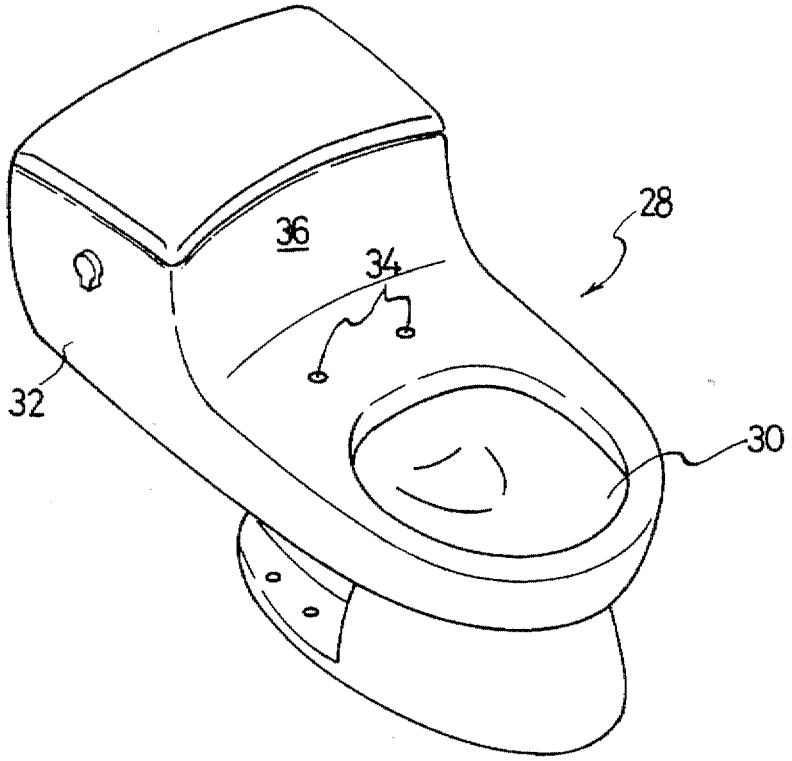
FIG. 7 is a perspective view of a conventional toilet bowl fixture.

The housing 12 is designed to be adaptive to the commercially available, conventional toilet bowl fixtures. As shown in FIG. 7, a conventional toilet bowl fixture 28 includes a bowl section 30 and a flushing water supply section such as a cistern 32. A pair of seat mounting holes 34 spaced apart by a standardized predetermined distance are formed between these sections. The housing 12 is mounted on the upper surface of the toilet bowl fixture 28 by making use of these holes 34 as described later. Typically, the popular toilet bowl fixture is made in the form of a single piece earthenware provided with a bowl section 30 and a cistern 32 integral therewith and the front surface 36 of the cistern is curved along the rear contour of the bowl 30, as shown. In the illustrated embodiment, therefore, the housing 12 is provided with an overall configuration which is curved along the curved front surface 36 of the cistern and, hence, along the rear contour of the bowl 30, so as to be adapted to the toilet bowl fixture 28 of the popular design. However, the housing 12 may be made in a more straight form. Also, the housing 12 may equally be mounted to almost any type of the conventional toilet bowl fixture having a separate cistern or a flushing valve.

Figure 6:
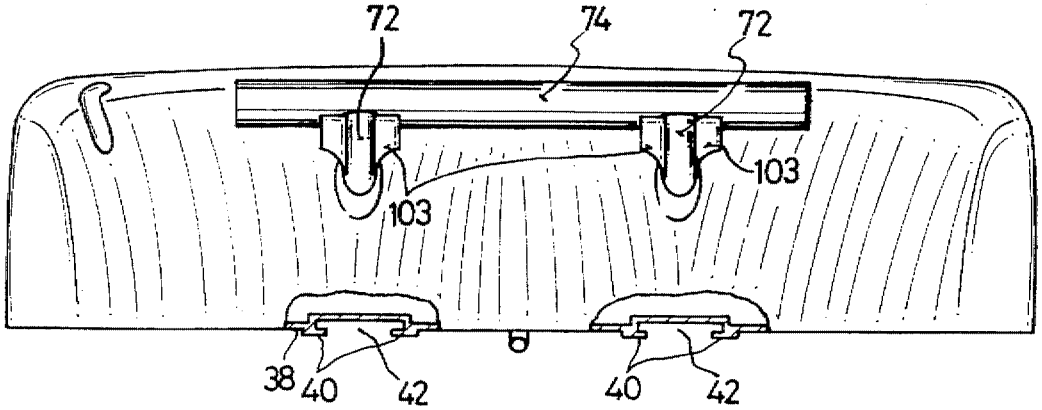
FIG. 6 is a front elevational view of the housing shown in FIG. 1, with parts of the housing being cut away to show slide rails.
Figure 8A:
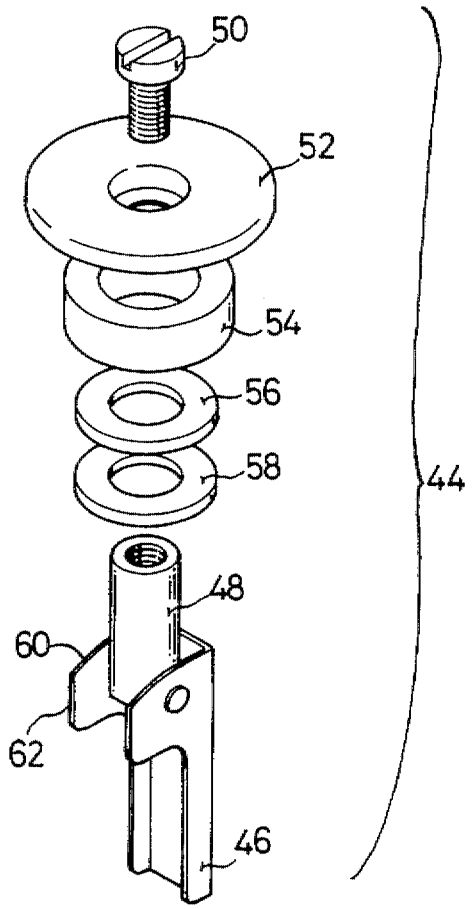
FIG. 8A is an exploded perspective view of a fastening mechanism of the housing shown in FIG. 1.
Figure 8B:
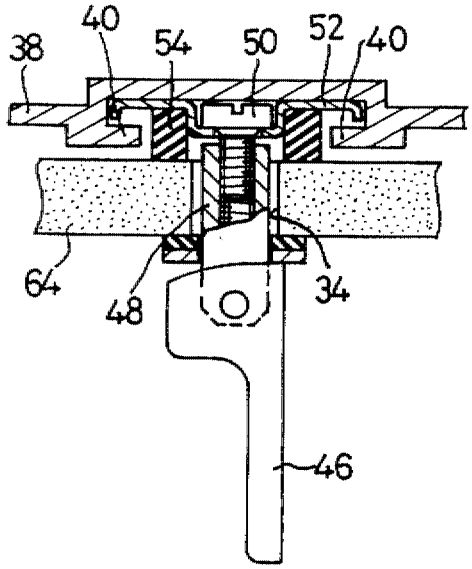
FIGS. 8B and 8C are enlarged cross-sectional views of the slide rails shown in FIG. 6 and showing the manner in which the housing is fixed to the toilet bowl fixture by the fastening mechanism shown in FIG. 8A.
Figure 8C:
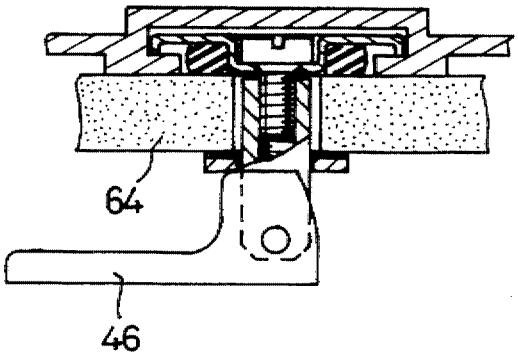

The housing 12 is designed to be readily secured to the toilet bowl fixture by a pair of levered fastening mechanisms in a manner adjustable in the fore-and-aft direction. To this end, as shown in FIGS. 6, 8B and 8C, the bottom plate 38 of the lower housing 24 is provided with two pairs of slide rails 40 extending for a predetermined length in the longitudinal direction of the bowl fixture, each pair of the slide rails 40 forming a slot 42 of a T-shaped cross-section. The distance between the two slots 42 is equal to the standardized distance between the seat mounting holes 34. As best shown in FIG. 8A, each of the fastening mechanisms 44 may be comprised of a pull rod 48 having a lock lever 46 pivoted thereto and provided with a threaded bore, a screw 50 engageable with the pull rod 48, a dish-shaped retainer 52 of sheet metal having an enlarged diameter and engageable with the slide rails 40, an elastomeric ring 54, a packing 56 and a washer 58. The lock lever 46 has a curved cam surface 60 and a flat locking surface 62.

To install the housing 12 onto the bowl fixture 28, each of the pull rods 48 loaded with the packing 56 and washer 58 is first inserted from the underside of a flange 64 of the bowl fixture upwardly into the associated seat mounting hole 34 and, after placing the elastomeric ring 54 and the retainer 52 on the upper surface of the flange 64, the screw 50 is then screwed into the pull rod 48 to the degree that the elastomeric ring 54 is not compressed, as shown in FIG. 8B. In this state, the retainer 52 is spaced by the elastomer ring 54 upwardly away from the flange 64. Then the housing 12 is held and moved to bring the retainers 52 into engagement with the slots 42 as shown in FIG. 8B. As the housing 12 is slid rearwards until it is brought in an appropriate position on the bowl fixture 28, the levers 46 are then rotated as shown in FIG. 8C, whereupon the retainers 52 are pulled downwards by the pull rods 48 to compress the elastomeric ring 54 until the slide rails 40 are brought into tight contact with the flange 64 thereby to fix the housing on the bowl fixture.

As in this manner the housing 12 is secured to the bowl fixture 28 by a single-touch manual operation of the levers 46 without using a tool such as a wrench and spanner, it is easy for an ordinary user to install the housing. To bring the bidet system 18 in an operable condition, it will then suffice to connect a water supply hose 66 to a branch adapter 68 in a water line and to connect a plug of an electric cord 70 to a plug socket, as shown in FIG. 1.

Figure 9:
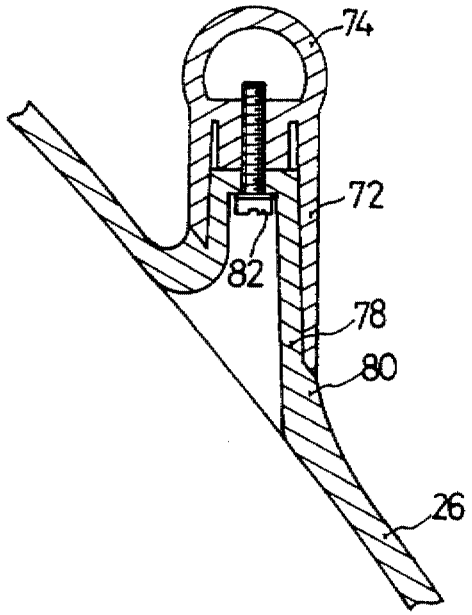
FIG. 9 is an enlarged cross-sectional view taken along the line IX—IX of FIG. 4.
Figure 10:
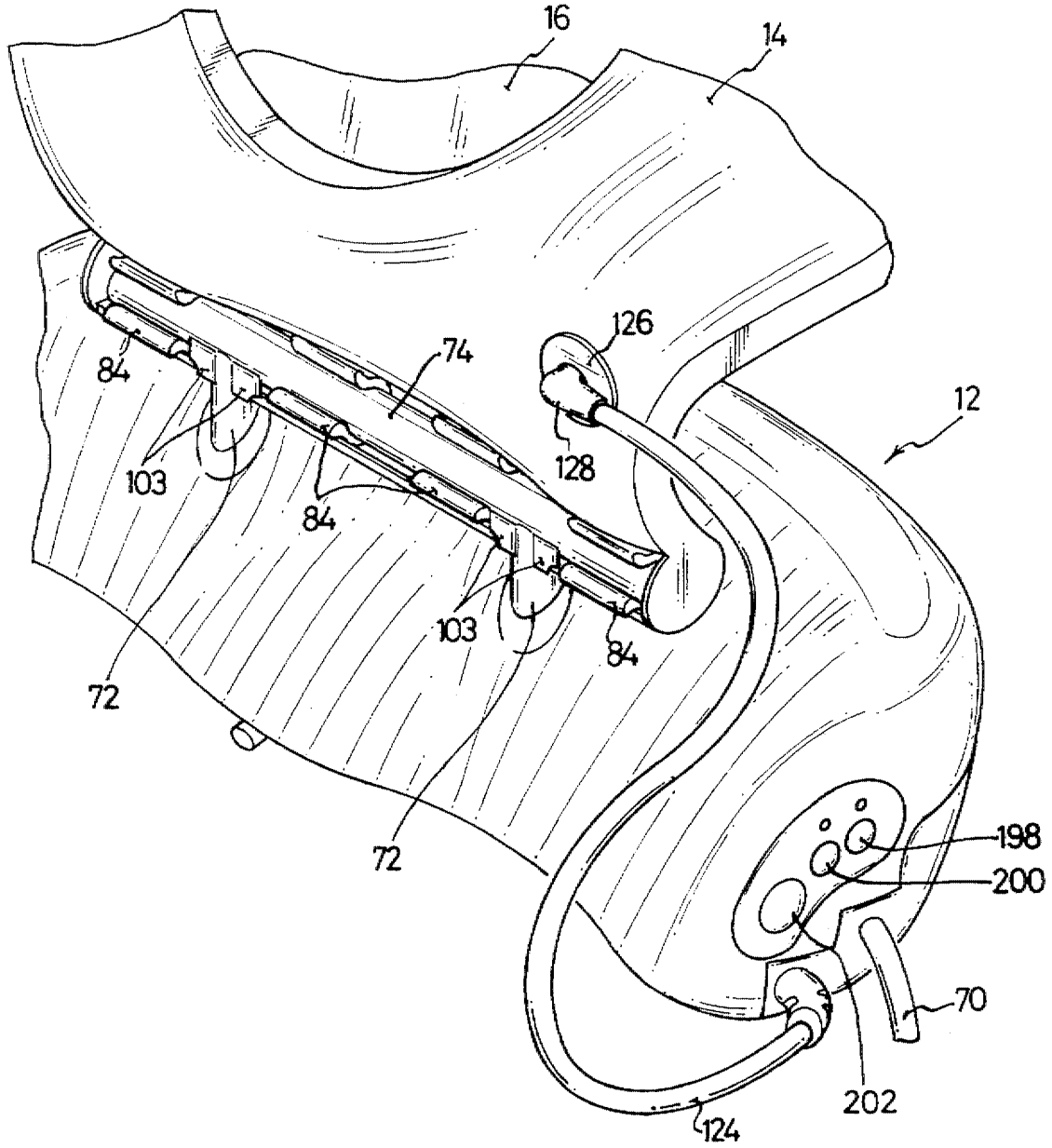
FIG. 10 is a perspective view of a part of the assembly shown in FIG. 1, with the toilet seat and the toilet lid being shown as being in their swung-up positions.

As best shown in FIGS. 4 and 10, at a level roughly equal to the level of the top of the housing, a horizontal hinge shaft 74 is supported on the housing 12 by a pair of rigid posts or supports 72. In the illustrated embodiment, the housing 12 has a rearwardly and upwardly inclined front surface 76 from which the posts 72 extend upright. As shown in FIG. 9, the hinge shaft 74 and the posts 72 are integrally formed by molding of an ABS resin. Alternatively, they may be made separately and firmly joined together by bolt and nut or adhesives. Similarly, the hinge shaft 74, the posts 72 and the upper housing 26 may all be molded to form a single piece.

As shown in FIG. 9, the upper housing 26 is provided with a pair of tubular supports 78 reinforced by respective bosses 80. The posts 72 are firmly joined with the supports 78 by press-fitting the posts 72 over the supports 78 and by screwing associated screws 82. The mating faces of the posts 72 and the supports 78 may be tapered upwardly so as to establish a close fit.

Figure 2:
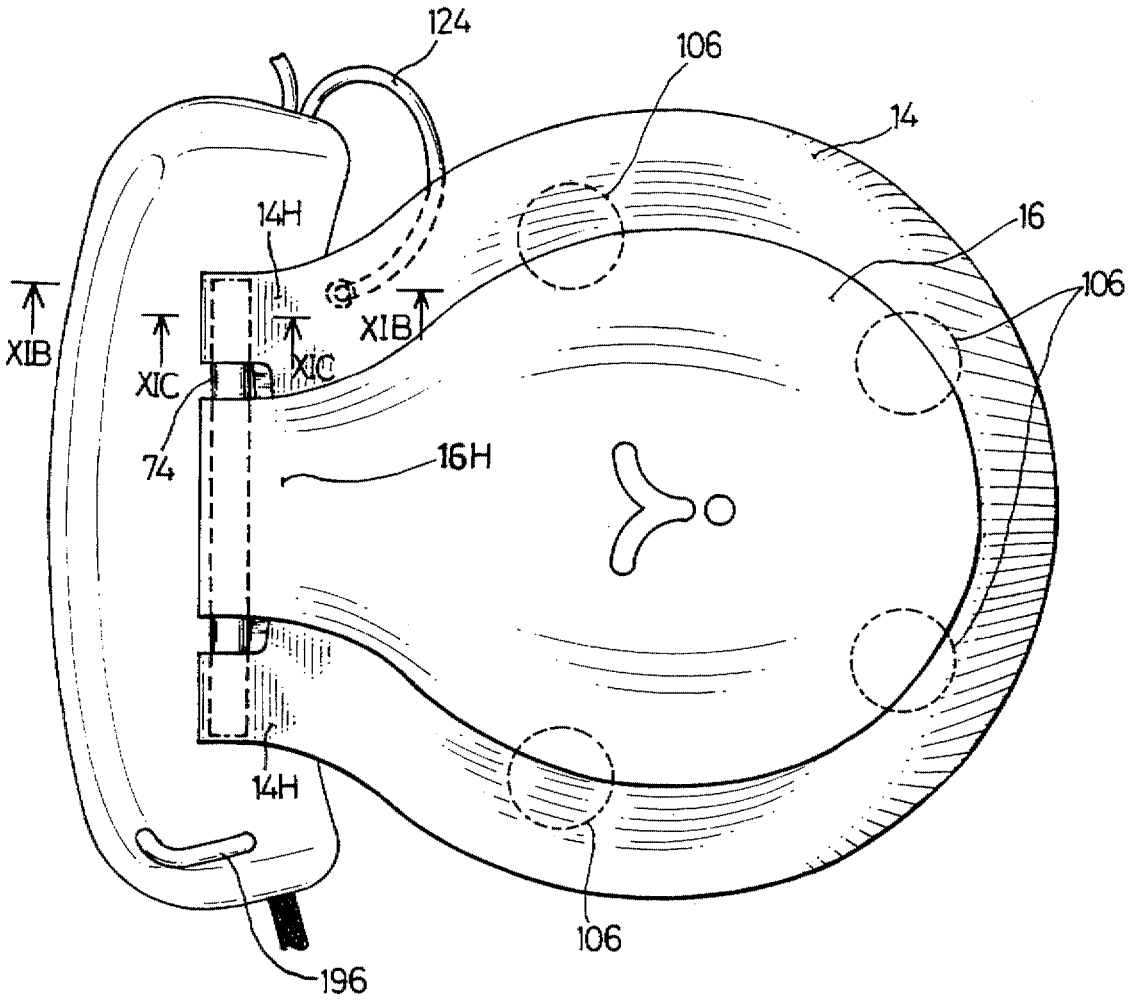
FIGS. 2 and 3 are top plan and side elevational views, respectively, of the assembly shown in FIG. 1, with the toilet lid being shown as being in the closed position.

The hinge shaft 74 has a cylindrical outer periphery. The toilet seat 14 and the toilet lid 16 are pivotally and detachably hinged to the hinge shaft by means of a plurality of elastic collars 84. The toilet seat 14 has a pair of spaced hinge portions 14H, as best shown in FIGS. 1 and 2, which are snap-fitted respectively over the ends 74H (FIG. 4) of the hinge shaft by the associated elastic collars 84 at locations outwardly of the posts 72, as shown in FIG. 10. The toilet lid 16 has a single central hinge portion 16H which is snap-fitted over the central portion 74C of the hinge shaft by a pair of elastic collars 84 at a location inwardly of the two posts 72.

Figure 11A:
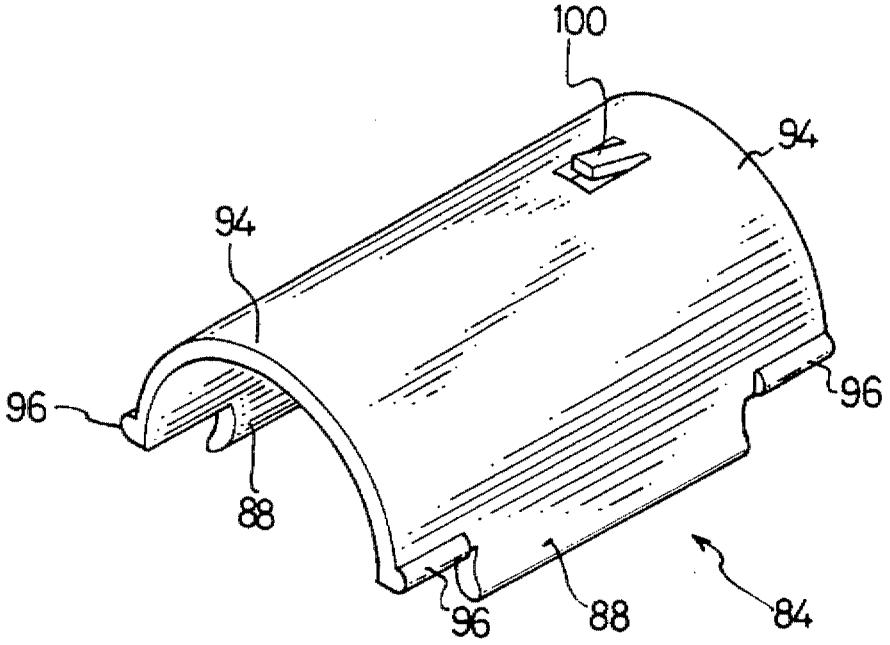
FIG. 11A is a perspective view of the elastic collar of the hinge mechanism of the toilet seat and the toilet lid shown in FIG. 1.
Figure 11B:
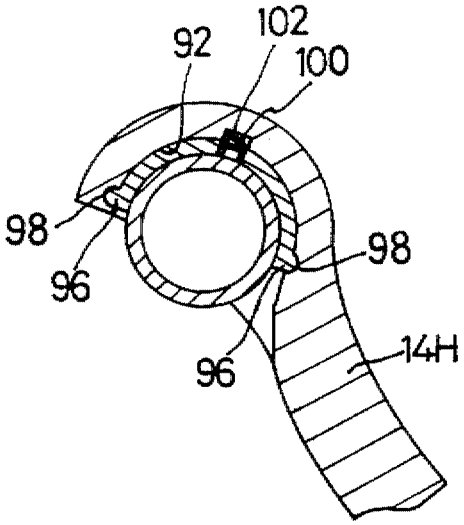
FIGS. 11B and 11C are cross-sectional views taken along the lines XIB—XIB and XIC—XIC Of FIG. 2, respectively.
Figure 11C:
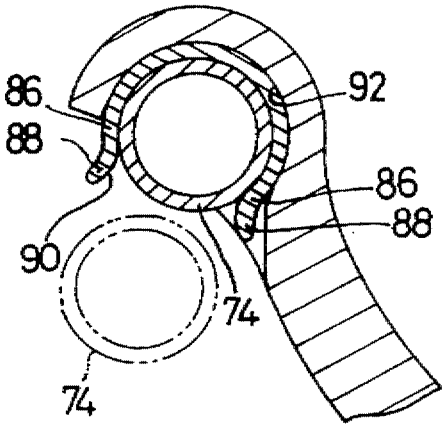

As the snap-fit arrangements of the hinge portions 14H of the toilet seat and the hinge portion 16H of the toilet lid are basically the same, only the arrangement related to one of the hinge portions 14H of the toilet seat will be described. Referring to FIGS. 11A, 11B and 11C, the elastic collar 84 is made of a plastic material such as polypropylene and has a generally C-shaped cross-section. The elastic collar 84 has an inner diameter equal to the outer diameter of the hinge shaft 74 and has a pair of opposite jaws 86. The ends of the jaws 86 are connected respectively to a pair of skirts 88 which are provided with tapered guide surfaces 90.

The hinge portion 14H of the toilet seat is formed with a bearing surface 92 of a semicircular cross-section having an inner diameter equal to the outer diameter of the collar 84 to support the collar 84 by the bearing surface 92. The collar 84 may be fixed to the bearing surface 92 by means such as adhesives. Preferably, however, the collar 84 is replaceably and detachably mounted to the hinge portion 14H. For this purpose, the collar 84 is provided at its ends with extensions 94 having a semicircular cross-section, the opposite ends of each extension 94 being formed with beads 96, respectively. Each bead 96 is adapted to engage a corresponding notch 98 formed on the bearing surface 92 of the hinge portion 14H. The elastic collar 84 is also provided with an outwardly biased stopper 100 which is adapted to engage a notch 102 on the bearing surface 92 to prevent the axial displacement of the collar 84. As will be understood from FIG. 11C, when the elastic collar 84 is mounted to the hinge portion 14H, the jaws 86 and the skirts 88 of the collar are protruded downwards beyond the bearing surface 92 so as not to interfere with the hinge portion 14H.

With this arrangement, whenever it is desired to dismount the toilet seat 14 and/or the toilet lid 16 for cleaning, it will be sufficient for the user to engage the hands under the hinge portion 14H or 16H and to simply pull them upwards whereupon the hinge shaft 74 will spread the jaws 86 apart against the spring action so that the hinge portion is readily disengaged from the hinge shaft as shown by the ghost line in FIG. 11C. As the hinge shaft 74 as well as the posts 72 have simply cylindrical outer surfaces, they can be easily cleaned such as by wiping once the toilet seat 14 and the toilet lid 16 have been removed. To re-install the toilet seat 14 and/or the toilet lid 16, the skirts 88 of the elastic collar 84 are brought into engagement with the hinge shaft 74 and the hinge portion 14H or 16H is then pressed down by hands. The hinge shaft 74 will urge the skirts 88 and the jaws 86 to be spaced apart on entering into the inside of the elastic collar 84. Finally, the jaws 86 will resiliently grip the hinge shaft 74 under the spring-back action so that the elastic collar 84 is snap-fitted on the hinge shaft 74 as shown by the solid line.

In this manner, the toilet seat 14 and the toilet lid 16 may be easily dismounted by anyone only by a single manual operation and may be equally easily re-installed. As the snap action of the C-shaped elastic collars is readily understood by anyone at a glance, the user will quickly recognize that the toilet seat and the toilet lid are detachable and how they can be detached. The removal and re-installation of the toilet seat 14 and the toilet lid 16 may be carried out mostly without regard to the angular position thereof. In general, however, it will be convenient to dismount and re-attach them when they are in the horizontal position. As will be apparent from FIG. 10, the posts 72 and the hinge shaft 74 may be provided with stoppers 103 against which the end faces of the hinge portions of the toilet seat 14 and the toilet lid 16 are brought into abutment to limit the angle of rotational movement of the toilet seat 14 and the toilet lid 16.

Figure 12A:
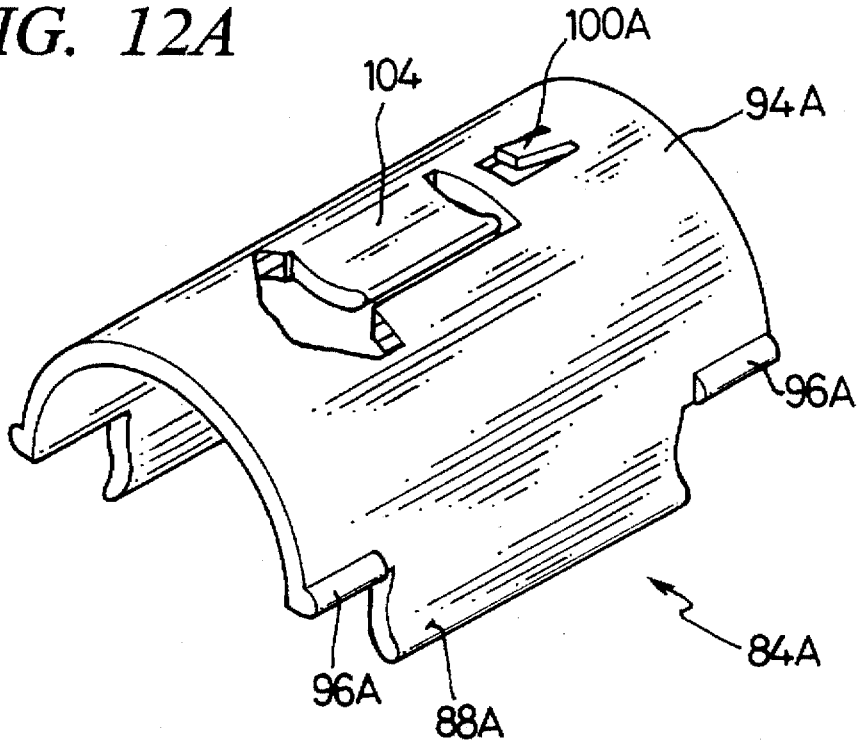
FIGS. 12A, 12B and 12C are views similar to FIGS. 11A, 11B and 11C, respectively, but showing a modified version of the elastic collar.
Figure 12B:
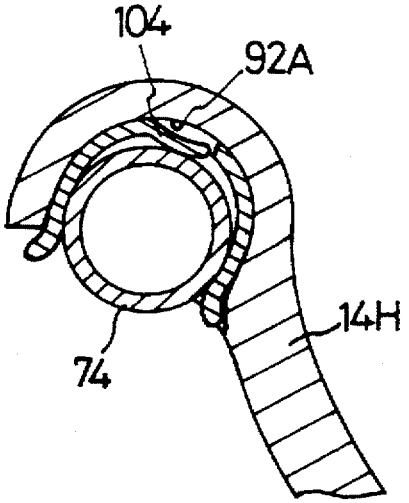
Figure 12C:
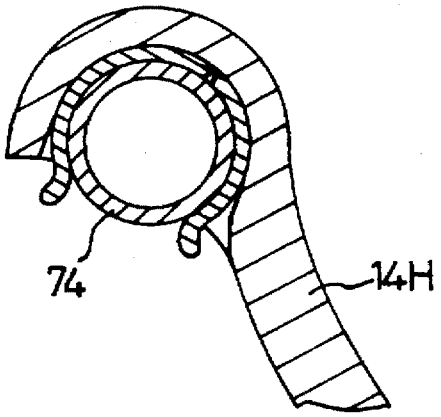

In FIGS. 12A, 12B and 12C, there is shown a modified embodiment of the elastic collars and the associated hinge portions. Parts and members similar to those of the foregoing embodiment are indicated by like reference numerals with a suffix A and will not be described again. In the modified embodiment, the elastic collar 84A has a slightly elongated cross-section and the bearing surface 92A of the hinge portion has a correspondingly elongated cross-section. The central portion of the elastic collar 84A is provided with a C-shaped cut out to form a cushioning portion 104 which is bulged radially inwardly. When the toilet seat 14 and the toilet lid 16 are unloaded, the elastic collar 84A will engage the hinge shaft 74 by a three point contact as shown in FIG. 12B so that a small clearance will be secured between the top of the bearing surface 92A of the hinge portion and the hinge shaft. As the user sits down so that the toilet seat 14 or the toilet lid 16 is loaded, the cushioning portion 104 undergoes elastic deformation as shown in FIG. 12C thereby to subdue or cushion the impact of loading.

Figure 13:
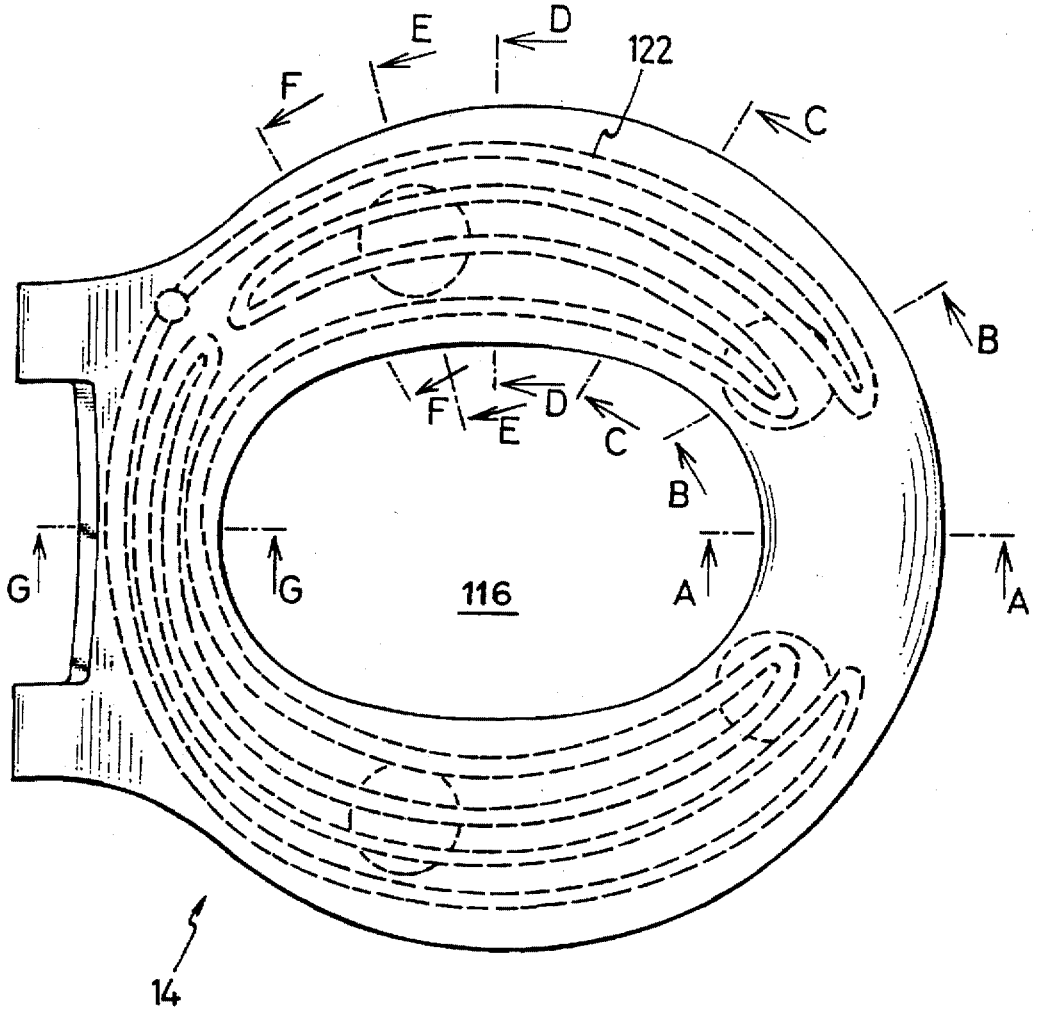
FIGS. 13 and 14 are top plan and side elevational views, respectively, of the toilet seat shown in FIG. 1.
Figure 14:
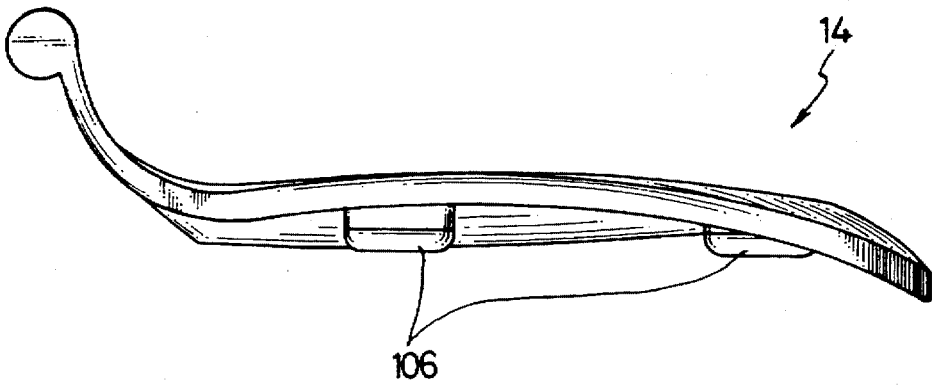

Referring to FIGS. 1, 13 and 14, the toilet seat 14 may include a pair of side portions 14S, a rear portion 14R, a front portion 14F and a backrest 14B. A plurality of rubber bumpers 106, numbering four for example, are affixed to the underside of the toilet seat to support the toilet seat on the upper surface of the rim 108 of the toilet bowl fixture 28 as shown in FIG. 16.

Figure 15D:
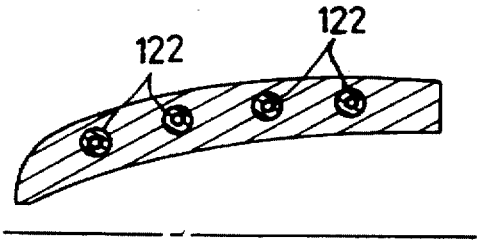
Figure 15E:
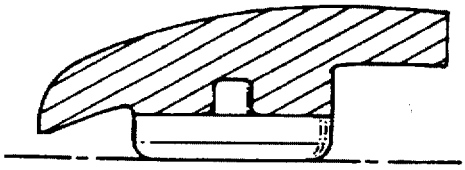
Figure 15F:
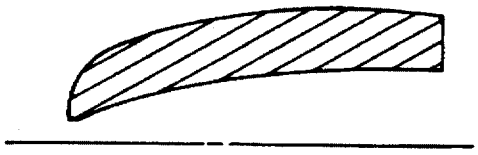
Figure 15G:
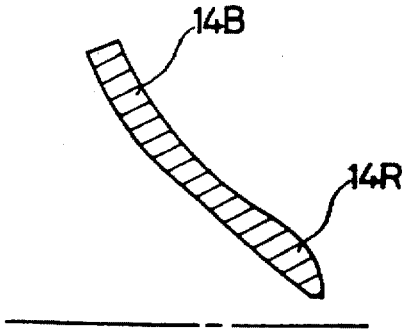
Figure 16:
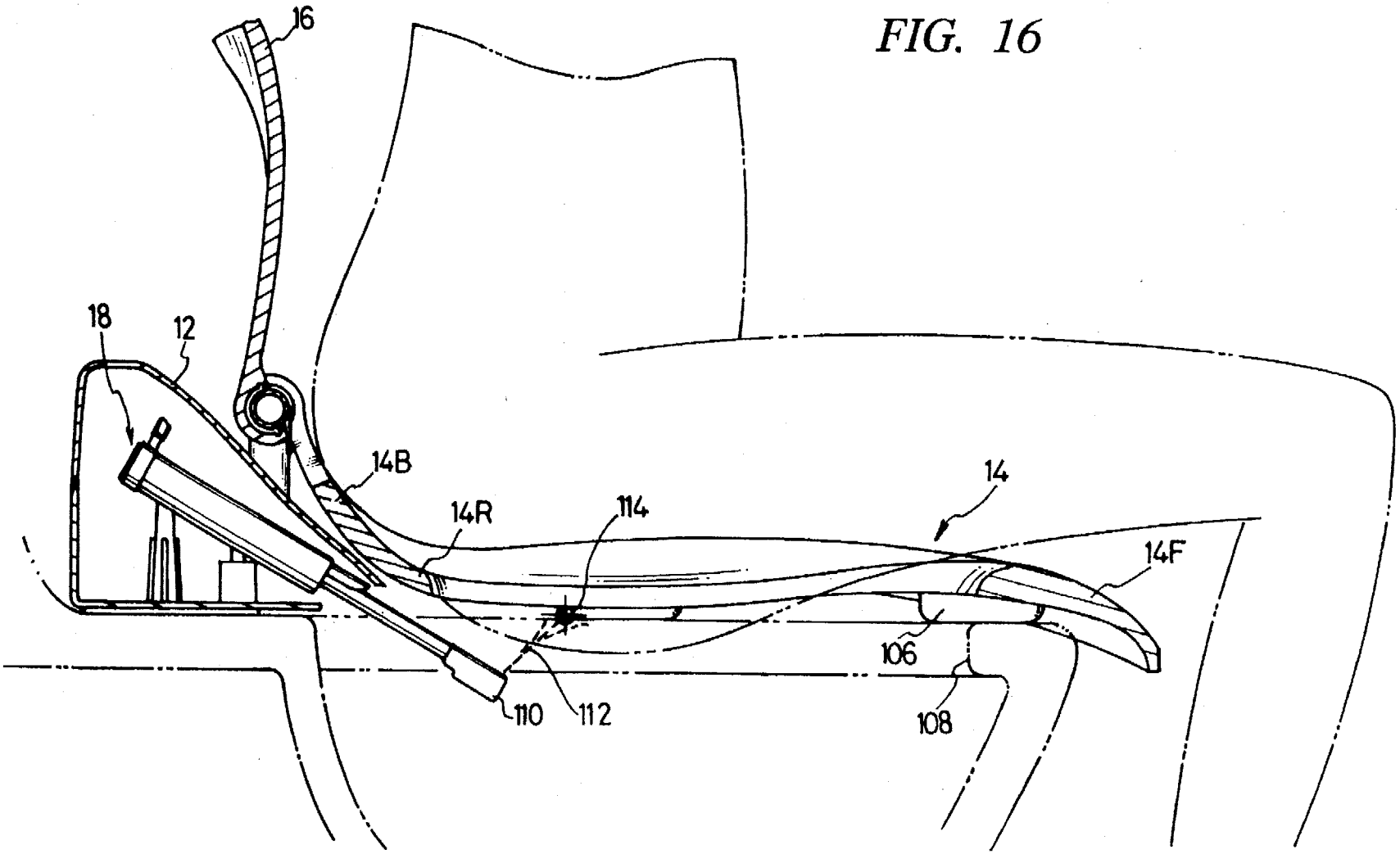
FIG. 16 is a cross-sectional view, taken along the central plane, of the assembly shown in FIG. 1, with the bidet system being shown as being in the operative position.

As will be apparent from FIGS. 1, 14, 15G and 16, the backrest 14B of the toilet seat extends rearwardly and upwardly at a steep angle from the rear portion 14R so as to support and locate the pelvis of the user. In addition, as shown in FIGS. 14, 15C–15F and 16, the side portions 14S of the toilet seat are inclined rearwardly and downwardly toward the rear portion 14R so as to bias and locate the buttocks of the user rearwardly toward the backrest 14B. With this arrangement, whenever the user is to be seated on the toilet seat, the user is assisted to easily occupy such a position that the perineal part of the user is properly positioned with respect to a protracted nozzle 110 of the bidet system 18, as shown in FIG. 16, thereby assuring a spray 112 of water ejected from the nozzle to hit on the target point 114 at the perineal part to effectively wash that part.

As best shown in FIG. 13, the side portions 14S of the toilet seat are designed to provide wider support surfaces for supporting the thighs of the user. To this end, the toilet seat 14 has a generally circular outer periphery and the inner periphery defining a seat opening 116 has an elongated contour. As after excretion the perineal part is washed by the bidet system 18, normally it would not be necessary to wipe the perineal part. Accordingly, it is preferable to design the seat opening 116 as narrow as possible in order to widen the support surface at the side portions 14S thereby to improve the support for the thighs. The side portions 14S of the toilet seat has a transverse width of about 9 cm and the seat opening 116 has a transverse width of about 15 cm.

Figure 3:
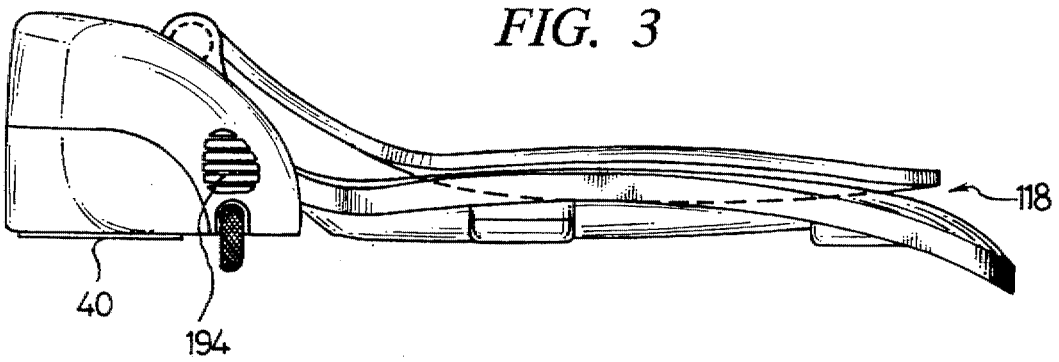
Figure 15A:
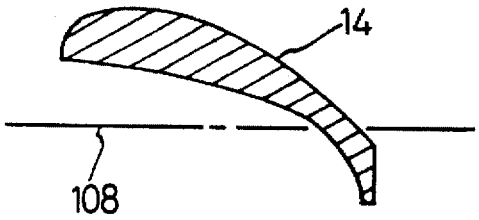
FIGS. 15A through 15G are cross-sectional views taken along the lines A—A, B—B, C—C, D—D, E—E, F—F, and G—G of FIG. 13, respectively, with the electric heater wire being omitted in figures other than FIG. 15D.
Figure 15B:
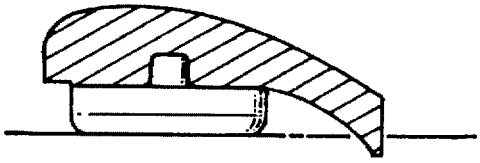
Figure 15C:
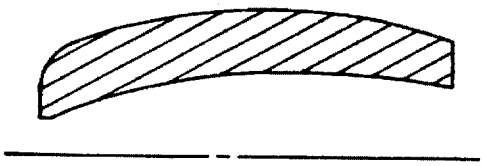

The front portion 14F of the toilet seat is inclined forwardly and downwardly as best shown in FIGS. 15B, 15A and 16. Consequently, the user is assisted in opening the legs to assume an easy posture. The downward inclination of the front portion 14F also serves to form a gap or clearance 118 between the front portion of the toilet seat and the front portion of the toilet lid as shown in FIG. 3. The user may easily lift the toilet lid 16 by inserting the fingers into the gap to grip the toilet lid.

The toilet seat 14 and the toilet lid 16 may be manufactured by molding of an impact resistive plastic such as an ABS resin. As will be understood from FIGS. 1 and 3, the toilet lid 16 has a concave upper surface to ensure that the user may sit down for any purposes like a chair. The toilet lid 16 has a thickness and a mechanical strength sufficient to withstand the weight of the user and is adapted to rest, by a surface contact, upon the side portions 14S and the front part 14F of the toilet seat when in use. As shown in FIG. 1, the toilet lid 16 is provided with through-openings 120 which represent the symbol of a fountain. The symbol of fountain appeals the presence of the bidet system 18 to the user who uses the assembly 10 for the first time so that the user is reminded of the use of the bidet system. Furthermore, when water is accumulated on the toilet for any reasons such as the use of a shower, the through-openings 120 permit water to be drained into the bowl.

In the illustrated embodiment, the toilet seat 14 is adapted to be heated by an electric heater to heat the user seated thereon in the cold season. As shown in FIGS. 13 and 15D, a sinusoidal heater wire 122 is embedded in the toilet seat 14. The heater wire 122 is omitted in the other drawings for simplicity. The electric power to the heater wire 122 is supplied from an electric cord 124. As shown in FIG. 10, an electric receptacle 126 connected to the heater wire 122 is arranged on the lower side of the toilet seat 14 and a connector plug 128 disposed at an end of the cord 124 is connected to the receptacle 126. The electric cord 124 preferably has such a length that, when the toilet seat is swung up, an adequate slack remains in the cord to permit a smooth rotation of the toilet seat. A temperature sensor such as a thermistor, not shown, is embedded in the toilet seat 14 in the conventional manner. The power supply to the heater is controlled by a control unit, described later, in response to the signal from the sensor in such a manner that the toilet seat is heated at a desired appropriate temperature.

Figure 5:
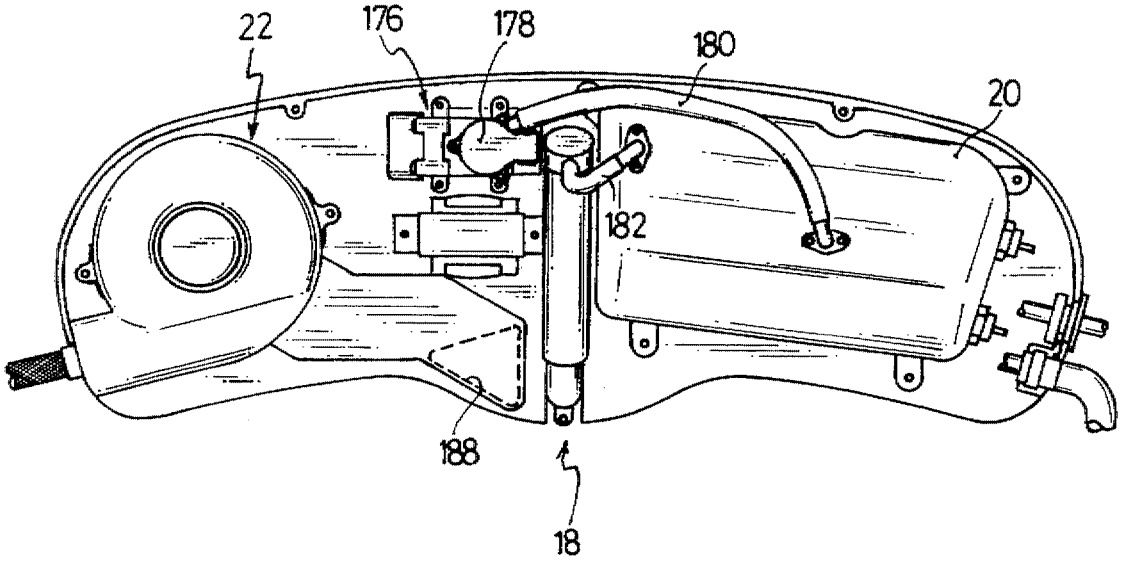
FIG. 5 is a plan view of a lower housing shown in FIG. 4.

As shown in FIGS. 4 and 5, the bidet system 18 is arranged at the center of the housing 12. The bidet system may be the conventional one. However, a simple form of the bidet system which can be manufactured at low costs and which is suitable to be incorporated into the assembly 10 according to the invention will be described below by way of an example with reference to FIG. 17. The bidet system 18 includes a cylinder 130 which is secured to supports 132 extending from the lower housing 24. A plunger 136 having an integral piston 134 is clearance fitted within the cylinder 130 in a slidable manner. Formed between the cylinder 130 and the plunger 136 is a spring chamber 138 in which a compression spring 140 is arranged to bias the plunger 136 to a retracted position shown by the solid line.

An axial passage 142 is formed to extend through the piston 134 and the plunger 136 and is in constant communication with a water inlet 144 of the cylinder 130. The inlet 144, in turn, is in communication with the spring chamber 138 via a small radial clearance between the cylinder 130 and the piston 134. Accordingly, when water under pressure is supplied to the inlet 144, water will flow into both the passage 142 and the spring chamber 138.

As shown in FIG. 17A, the end wall 146 of the cylinder 130 is formed with a circular opening 148 in which the forward part of the plunger 136 is slidably guided. A nozzle head 110 is mounted to the forward end of the plunger 136. As will be apparent from FIG. 17A, the upper part of the plunger 136 is chamfered substantially throughout the entire length thereof so that a water outlet 152 is formed between the circular opening 148 of the end wall 146 and the outer periphery of the plunger 136 throughout the stroke of the plunger 136. As a result, when water under pressure is supplied to the water inlet 144, water entering the spring chamber 138 will be ejected from the outlet 152 to wash the nozzle head 110. As shown in FIG. 17B, a cover 154 of a semicircular cross-section is arranged to project from the end wall 146 of the cylinder 130 so as to direct water ejected from the outlet 152 to flow along the nozzle head 110 thereby to effectively wash the nozzle head 110.

A packing 156 is arranged inwardly of the end wall 146 of the cylinder 130. When the plunger 136 is fully stroked as shown by the imaginary line in FIG. 17, the shoulder 158 of the plunger 136 abuts against the packing 156 to shut off the flow of water through the outlet 152. As shown in FIG. 17A, the side of the plunger 136 is provided with a spline 160 which is slidably engaged with a notch 162 formed in the end wall 146. By the splined engagement, the plunger 136 is held in a predetermined angular position during the telescoping movement.

The passage 142 of the plunger 132 is in communication with the inner passage of the nozzle head 110 through a restriction 164 of a reduced diameter. Due to the presence of the restriction 164, the water pressure acting on the piston 134 becomes higher than the atmospheric pressure prevailing in the spring chamber 138 when water under pressure is supplied to the water inlet 144, thereby causing the plunger 132 to stroke against the action of the return spring 140.

In the illustrated embodiment, the nozzle head 110 is designed to form and eject a frothed spray. The nozzle head 110 may be made for example in a cylindrical form and includes a radial passage 166 communicated with the orifice 164, an axial passage 168 having a reduced diameter to provide a venturi effect, and an outlet port 170. An air intake port 172 opens into the venturi passage 168 to introduce by the venturi effect air bubbles into the water flow flowing through the passage 168.

Warmed water is supplied from the warmed water reservoir 20 to the bidet system 18. Referring to FIGS. 1, 4 and 5, tap water may be fed to the reservoir 20 via the water hose 66, a hose 174 extending within the housing, a conventional valve unit 176, a conventional vacuum breaker 178, and a hose 180. The warmed water reservoir 20 is connected to the inlet 144 of the bidet system through a hose 182. To facilitate connection to the branch adapter 68, the water hose 66 is preferably made of a flexible hose sheathed with a metal mesh. The valve unit 176 may comprise a pressure reduction valve, a solenoid operated shut-off valve and a flow rate control valve in the conventional manner, with the shut-off valve being controlled by a control unit 184 having a power source circuit and a microcomputer. As shown in FIG. 4, a heat exchanger 186 incorporating an electric heater controlled by the control unit 184 is arranged in the warmed water reservoir 20 to heat water in the reservoir.

In the illustrated embodiment, the housing 12 further receives the conventional deodorizer and ventilation fan unit 22 to ventilate the bowl 30 and to deodorize the ventilated air during use of the toilet. As shown in FIGS. 4 and 5, the bottom plate 38 of the lower housing 24 is provided with an opening 188 facing the bowl 30, the opening being communicated with the ventilation unit 22 through a duct formed by a vertical enclosing wall 190 and a cover 192 therefor. The deodorizer and ventilation fan unit 22 may be of the conventional one having an air passage charged with activated carbon and deodorizing catalyst and is adapted to draw and deodorize air within the bowl and to circulate processed air into the ambient atmosphere. The deodorizer and ventilation fan unit 22 is automatically controlled by the control unit 184. To this end, the upper housing 26 is provided with an opaque sensor window 196 permeable to an infrared ray to ensure that an infrared ray is transmitted upwardly from a conventional infrared sensor, not shown, to detect the presence of the user in accordance with the ray reflected by the user. The control unit automatically operates the deodorizer and ventilation fan unit 22 as long as the user as seated on the toilet seat 14 is detected by the signal from the infrared sensor.

As shown in FIG. 10, the housing 12 is provided at the side thereof with a control switch 198 for the bidet system 18, a switch 200 for operating the electric heater of the reservoir 20, and a switch 202 for operating the heater 122 of the heated seat 14, these switches being connected to the control unit 184.

Once the housing 12 is mounted to the toilet bowl fixture 28 in a manner described before, and upon connecting the hose 66 to the branch adapter 68 with the plug of the cord 70 connected to the plug socket, the bidet system 18 will be ready for use. As the user is seated on the toilet seat 14 and presses on the switch 198, the solenoid valve of the valve unit 176 of the bidet system 18 is opened to allow tap water under pressure to flow into the warmed water reservoir 20 so that warmed water in the reservoir is displaced toward the inlet 144 of the bidet system 18. This causes warmed water under pressure to flow into the spring chamber 138 and the passage 142 whereby the plunger 136 commences its forward stroke and, at the same time, water in the spring chamber 138 is delivered from the outlet 152 to wash the nozzle head 110.

When the plunger 136 has fully stroked, the outlet 152 is closed by the plunger shoulder 158 abutting against the packing 156 whereupon warmed water is permitted to flow out only through the nozzle head 110 thereby forming a frothed spray 112 as shown in FIG. 16. Since the user is located by the toilet seat 14 such that the perineal part of the user is brought at the target point 114 as described before, the frothed spray hits on the perineal part to effectively wash that part.

To terminate use of the bidet system 18, it is sufficient to press on the switch 198 again. The solenoid valve is then slowly closed so that the water pressure in the cylinder 130 gradually drops. As a result, the plunger 136 commences its return stroke under the action of the spring 140. As soon as the shoulder 158 of the plunger 136 is moved away from the packing 156 to open the outlet 152, water is forced to flow out mainly through the outlet 152 due to the presence of the restriction 164. The nozzle head 110 will be washed with water substantially throughout the return stroke of the plunger 136 until the water pressure disappears.

Figure 18:
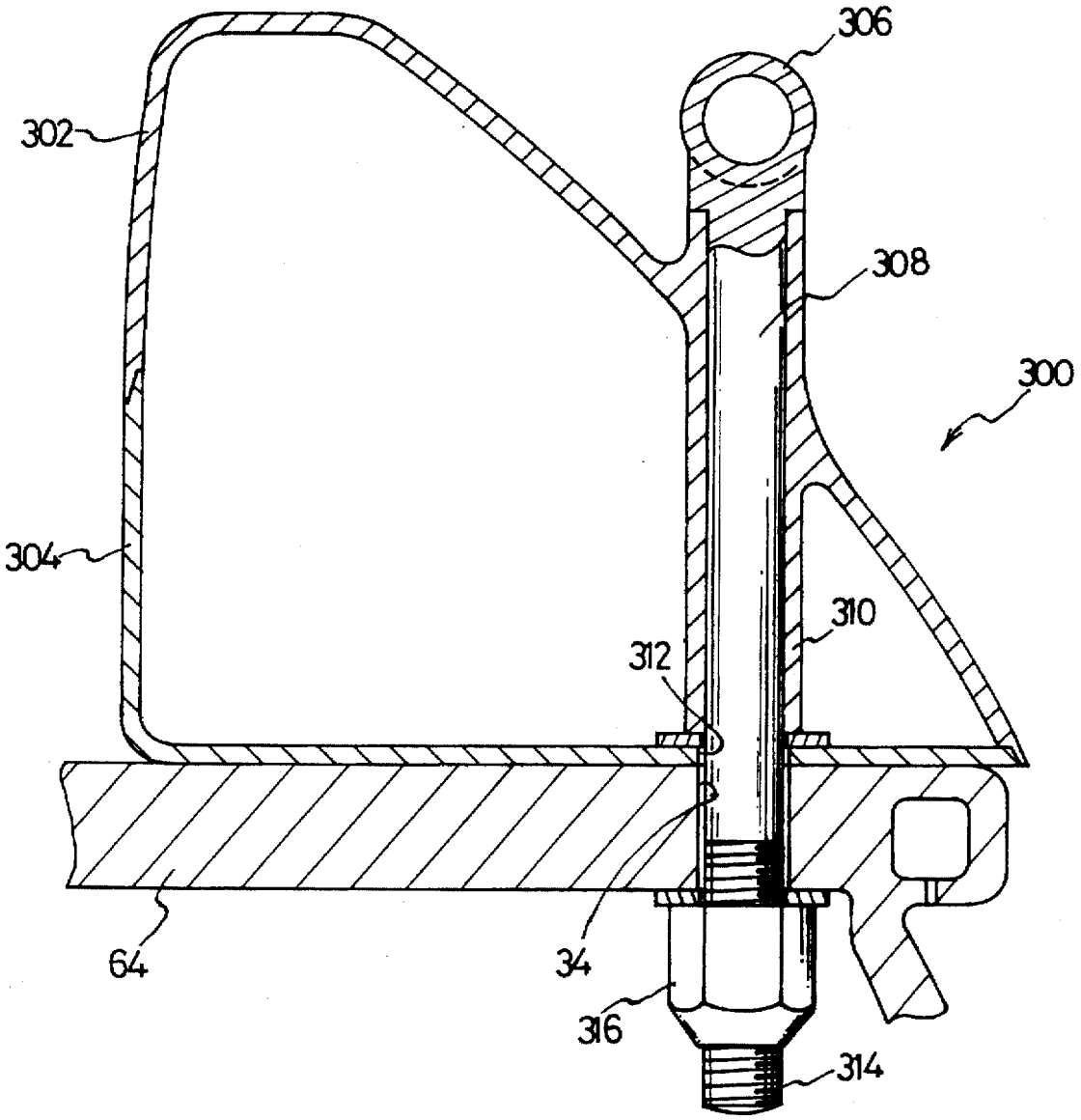

FIG. 18 illustrates the modified forms of the accessory housing, the hinge shaft and the posts therefor. In the modified form, the housing 300 is formed of the upper housing 302 and the lower housing 304, similar to the foregoing embodiment. The hinge shaft 306 is supported on the housing by a pair of integrally molded posts, only one of which is indicated by the reference numeral 308. For each of the posts 308, the upper housing 302 is formed with an integral tubular support 310 and the bottom plate of the lower housing 304 is provided with an opening 312. Each post 308 has a length sufficient to extend through the support 310 and to protrude beyond the lower face of the flange 64 of the toilet bowl fixture, the lower end of the post being threaded as shown at 314.

To mount the housing 300 on the toilet bowl fixture, the supports 310 of the upper housing and the openings 312 of the lower housing are aligned with the seat mounting holes 34 of the bowl fixture, respectively, and the posts 308 are then passed through the supports 310 and the holes 34 as shown and are fastened by associated nuts 316. The toilet seat 14 and the toilet lid 16 may be snap-fitted on the hinge shaft 306 in the same manner as the foregoing embodiment. As in the modified form the support 308 are used to fasten the housing, the fastening structure is simplified. However, as the supports 308 are arranged to extend within the housing, some restrictions must be imposed on the arrangement of the components of the toilet accessories.

While the present invention has been described herein with reference to the specific embodiments thereof, it is contemplated that the invention is not limited thereby and various modifications and alterations may be made therein without departing from the scope of the invention. For example, while the housing has been described as receiving the bidet system 18, the water reservoir 20 and the deodorizer and ventilation unit 22, other toilet accessories may be housed therein in lieu of or in addition to these accessories. Furthermore, the structure and arrangement of the bidet system 18 may be changed as required.

We claim:

1. In a combined toilet seat and accessory assembly having a housing adapted to be mounted on an upper surface of a toilet bowl fixture between a bowl section thereof and a flushing water supply section located rearwardly of said bowl section, a toilet seat hinged for pivoting movement to said housing, and toilet accessory equipment disposed in said housing, the improvement comprising:

a pair of posts spaced apart, secured to said housing, and extending substantially upright from said housing; and a horizontal hinge shaft supported by said posts and spaced upwardly away from an outer surface of said housing to a level higher than an upper surface of side portions of said seat, said posts being spaced apart a distance less than a width of the toilet seat, said seat comprising a hinge portion extending rearwardly and upwardly from a rear portion of said seat for engagement with said hinge shaft, said hinge portion of said seat being snap-fitted on said hinge shaft for detachment therefrom and for re-installation thereon by a single action of application of force.

2. The assembly according to claim 1, wherein said toilet seat comprises a pair of transversely spaced hinge portions snap-fitted respectively on the ends of said hinge shaft, said assembly further comprising a toilet lid hinged to said hinge shaft, said toilet lid having a hinge portion snap-fitted on the central portion of said hinge shaft for detachment therefrom and for re-installation thereon by a single action of application of force.

3. The assembly according to claim 1 or 2, wherein said hinge portion comprises an elastic member of a C-shaped cross-section having a pair of opposite ends for resiliently gripping said hinge shaft.

4. In a combined toilet seat and accessory assembly having a housing adapted to be mounted on an upper surface of a toilet bowl fixture between a bowl section thereof and a flushing water supply section located rearwardly of said bowl section, a toilet seat hinged for pivoting movement to said housing, and toilet accessory equipment disposed in said housing, the improvement comprising a horizontal hinge shaft supported on said housing by a pair of transversely spaced, substantially upright posts and spaced upwardly away from an outer surface of said housing to a level higher than an upper surface of side portions of said seat, said seat comprising a hinge portion extending rearwardly and upwardly from a rear portion of said seat for engagement with said hinge shaft, said hinge portion of said seat being snap-fitted on said hinge shaft for detachment therefrom and for re-installation thereon by a single action of application of force, wherein said hinge portion comprises an elastic member of a C-shaped cross-section having a pair of opposite ends for resiliently gripping said hinge shaft, and wherein said hinge portion has a bearing surface of a semicircular cross-section, said C-shaped elastic member being engaged in said bearing surface in such a manner that said opposite ends thereof are projected outwardly from said bearing surface.

5. The assembly according to claim 4, wherein said C-shaped elastic member comprises a pair of guide surfaces flaring out from said opposite ends so as to guide said elastic member with respect to said hinge shaft as said hinge portion is snap-fitted on said hinge shaft for re-installation.

6. The assembly according to claim 4, wherein said elastic member comprises cushioning means for resiliently supporting a load applied on said hinge shaft as the user is seated on said toilet seat or lid.

7. The assembly according to claim 1, 2, 4, 5, or 6, wherein said posts extend only outwardly of said housing without projecting into an inner space of said housing.

8. The assembly according to claim 1, 2, 4, 5, or 6, wherein said toilet accessory equipment comprises a bidet equipment having a movable spray nozzle supported by said housing for movement between an operative position in which a spray of water ejected from said nozzle is directed to a perineal part of a user seated on said seat to wash said part after excretion and an inoperative position in which said nozzle is retracted therefrom, said hinge portion of said toilet seat having a backrest surface inclined rearwardly and upwardly to support a pelvis of the user as seated on said toilet seat in such a manner as to locate the perineal part of the user with respect to said nozzle held in said operative position.

9. The assembly according to claim 8, wherein said housing has a front surface inclined forwardly and downwardly.

10. The assembly according to claim 9, wherein said housing has an overall configuration which is curved along the inner periphery of the rear part of the bowl.

11. The assembly according to claim 8, wherein the side portions of said toilet seat have rearwardly and downwardly inclined support surfaces for supporting thighs of the user, said support surfaces being operable to bias the buttocks of the user toward said inclined backrest surface to locate the perineal part of the user with respect to said nozzle held in said operative position.

12. The assembly according to claim 11, wherein said toilet seat has a forwardly and downwardly inclined frontal portion to permit legs of the user to open.

13. The assembly according to claim 8, wherein said toilet seat is provided with a generally circular outer periphery and an inner periphery defining an elongated seat opening, said side portions of said seat having a maximum transverse width of about 9 cm, said seat opening having a maximum transverse width of about 15 cm.

14. The assembly according to claim 2, wherein said toilet lid has a concave upper surface to permit the user to be seated thereon with ease.

15. The assembly according to claim 14, wherein said toilet lid is supported in an operative position thereof by said toilet seat through a surface contact.

16. In a combined toilet seat and accessory assembly having a housing adapted to be mounted on an upper surface of a toilet bowl fixture between a bowl section thereof and a flushing water supply section located rearwardly of said bowl section, a toilet seat hinged for pivoting movement to said housing, and toilet accessory equipment disposed in said housing, the improvement comprising a horizontal hinge shaft supported on said housing by a pair of transversely spaced, substantially upright posts and spaced upwardly away from an outer surface of said housing to a level higher than an upper surface of side portions of said seat, said seat comprising a hinge portion extending rearwardly and upwardly from a rear portion of said seat for engagement with said hinge shaft, said hinge portion of said seat being snap-fitted on said hinge shaft for detachment therefrom and for re-installation thereon by a single action of application of force, wherein said toilet seat comprises a pair of transversely spaced hinge portions snap-fitted respectively on the ends of said hinge shaft, said assembly further comprising a toilet lid hinged to said hinge shaft, said toilet lid having a hinge portion snap-fitted on the central portion of said hinge shaft for detachment therefrom and for re-installation thereon by a single action of application of force, wherein said toilet lid has a concave upper surface to permit the user to be seated thereon with ease, and is supported in an operative position thereof by said toilet seat through a surface contact, wherein said toilet seat has a forwardly inclined frontal portion so that a gap is defined between said frontal portion of said seat and the frontal portion of said lid to permit the user to readily engage the finger with said frontal portion of said lid to open the lid.

17. In a combined toilet seat and accessory assembly having a housing adapted to be mounted on an upper surface of a toilet bowl fixture between a bowl section thereof and a flushing water supply section located rearwardly of said bowl section, a toilet seat hinged for pivoting movement to said housing, and toilet accessory equipment disposed in said housing, the improvement comprising a horizontal hinge shaft supported on said housing by a pair of transversely spaced, substantially upright posts and spaced upwardly away from an outer surface of said housing to a level higher than an upper surface of side portions of said seat, said seat comprising a hinge portion extending rearwardly and upwardly from a rear portion of said seat for engagement with said hinge shaft, said hinge portion of said seat being snap-fitted on said hinge shaft for detachment therefrom and for re-installation thereon by a single action of application of force, wherein said toilet seat comprises a pair of transversely spaced hinge portions snap-fitted respectively on the ends of said hinge shaft, said assembly further comprising a toilet lid hinged to said hinge shaft, said toilet lid having a hinge portion snap-fitted on the central portion of said hinge shaft for detachment therefrom and for re-installation thereon by a single action of application of force, wherein said toilet lid has a concave upper surface to permit the user to be seated thereon with ease, and is provided at the center thereof with one or more through-openings to permit water on said lid to be drained into the bowl.

18. The assembly according to claim 17, wherein said through-openings of said lid are shaped in the form of a symbol representing a fountain.

19. The assembly according to claim 1, 4, 16 or 17, wherein said housing is adapted to be secured by fastening means to the toilet bowl fixture in a manner adjustable in a fore-and-aft direction.

20. The assembly according to claim 19, wherein said fastening means comprises transversely spaced two pairs of slide rails provided on the lower surface of said housing, a pair of pull rods adapted to be inserted, respectively, through a pair of seat mounting holes formed in said toilet bowl fixture, each of said pull rods having a head of an enlarged diameter engaging each pair of said slide rails, and a pair of levers for axially displacing said pull rods, respectively.

21. The assembly according to claim 1 or 4, wherein said posts are arranged to extend through said housing and through a pair of seat mounting holes in said toilet bowl fixture to protrude beyond a lower surface of a rear flange of said bowl fixture and wherein said housing is secured to said bowl fixture by engaging fastening means, which engages lower extensions of said posts with the lower surface of the rear flange of said bowl fixture.

22. In a bidet system having a housing adapted to be mounted on an upper surface of a toilet bowl fixture between a bowl section thereof and a flushing water supply section located rearwardly of said bowl section, a toilet seat hinged for pivoting movement to said housing, and a movable spray nozzle supported by said housing for movement between an operative position in which a spray of water ejected from said nozzle is direct to a perineal part of a user seated on said seat to wash said part after excretion and an inoperative position in which said nozzle is retracted therefrom, the improvement comprising:

a pair of posts spaced apart, secured to said housing, and extending substantially upright from said housing; and a horizontal hinge shaft supported by said posts and spaced upwardly away from an outer surface of said housing to a level higher than an upper surface of side portions of said seat, said posts being spaced apart a distance less than a width of the toilet seat, said seat comprising a hinge portion extending rearwardly and upwardly from a rear portion of said seat for engagement with said hinge shaft, said hinge portion of said seat being snap-fitted on said hinge shaft for detachment therefrom and for re-installation thereon by a single action of application of force.

* * * * *

UNITED STATES PATENT AND TRADEMARK OFFICE

CERTIFICATE OF CORRECTION

PATENT NO. : 5,666,672

DATED : September 16, 1997

INVENTOR(S) : Ayse BIRSEL et al.

It is certified that error appears in the above-indentified patent and that said Letters Patent is hereby corrected as shown below:

Claim 11, column 13, line 7, after "bias" delete "the".

Signed and Sealed this

Thirteenth Day of January, 1998

Bruce Lehman

*Attest:*

BRUCE LEHMAN

*Attesting Officer*

*Commissioner of Patents and Trademarks*